United States Patent [19]

Lee

[11] 4,149,553

[45] Apr. 17, 1979

[54] OPENING AND CLOSING DEVICE FOR AN UMBRELLA

[76] Inventor: Ying-I Lee, 63, Sec. 1, Chung-Shin Rd.,, San-Chung City, Taipei Hsien, Taiwan

[21] Appl. No.: 926,808

[22] Filed: Jul. 21, 1978

[51] Int. Cl.[2] ..... A45B 19/00; A45B 25/14

[52] U.S. Cl. ..... 135/24

[58] Field of Search ..... 135/24, 23, 22, 20 M

[56] References Cited

U.S. PATENT DOCUMENTS

| | | | |
|---|---|---|---|
| 735,776 | 8/1903 | Kaltenecker | 135/24 |
| 1,091,895 | 3/1914 | Schaaf | 135/24 |
| 2,454,059 | 11/1948 | Heaney | 135/24 |
| 3,796,226 | 3/1974 | Yuen | 135/24 |
| 3,926,202 | 12/1975 | Uthemann | 135/20 |

*Primary Examiner*—Reinaldo P. Machado

[57] ABSTRACT

The present invention relates to an opening and closing device for an umbrella which can be easily handled by a single hand; in which a button structure is positioned between a handle and a shaft to control an open-close transmission device rotated by a ratchet gear, thereby to actuate hard steel wire thereof to retract periodically, thus the opening and closing of the umbrella can be handled by a single hand.

4 Claims, 5 Drawing Figures

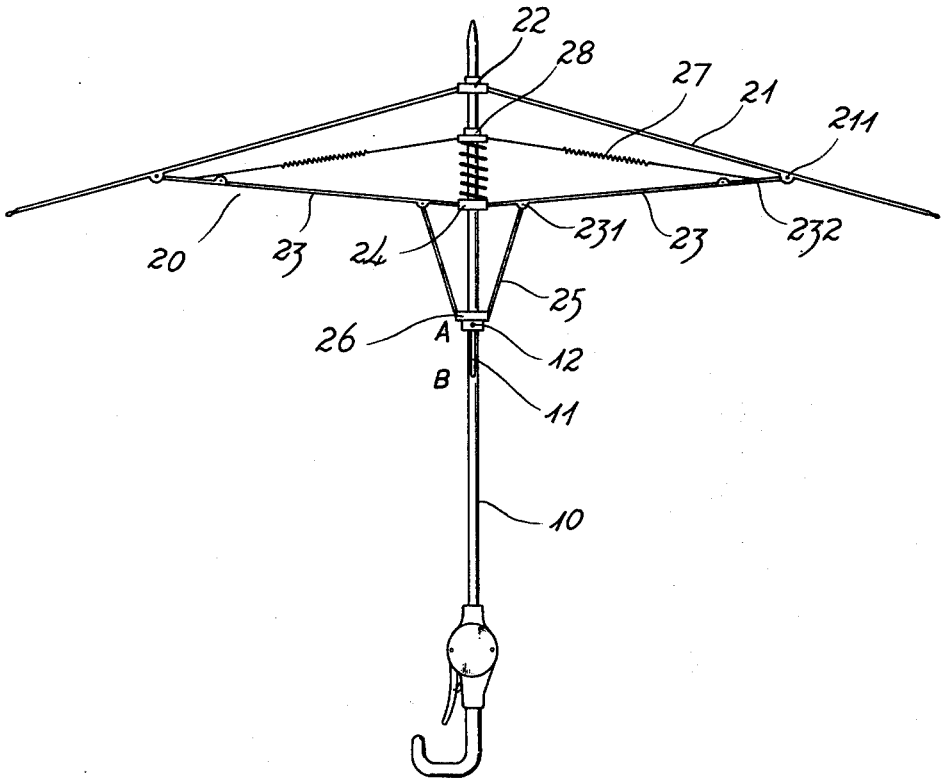

OPENING AND CLOSING DEVICE FOR AN UMBRELLA

BACKGROUND OF THE INVENTION

1. Field of the Invention:

The present invention relates to an opening and closing device for an umbrella which enables a user to control the opening and closing of the umbrella with a single hand.

2. Description of the Prior Art:

The conventional umbrella (as shown in FIG. 1) will be opened or closed only when the user holds the handle with one hand and pushes or pulls the lower runner with another hand, it is not convenient for the user when he carries some articles such as a bag, basket, book and the like. To overcome the disadvantages mentioned above, an improved umbrella as shown in FIG. 2 is provided which can be opened automatically, but it still needs to be closed by the user's two hands.

SUMMARY OF THE INVENTION

A main object of this invention is to provide an automatic opening and closing device for an umbrella, in which a hard steel wire is connected to the lower runner and a ratchet gear, so as to make the hard steel wire move parallel to the umbrella shaft when the device is actuated by pushing the trigger thereof, and thereafter drive the stretcher and the main ribs for opening or closing the cover of the umbrella.

Another object of the present invention is to provide an umbrella wherein the automatic opening and closing means has a ratchet with an even number of teeth. When said ratchet is actuated to rotate once, the umbrella completes the operation of opening and closing once.

Those and other objects and advantages will be apparent from the following detailed description with reference to the accompanying drawings.

DETAILED DESCRIPTION OF THE PREFERRED EMBODIMENTS

Figure 1:
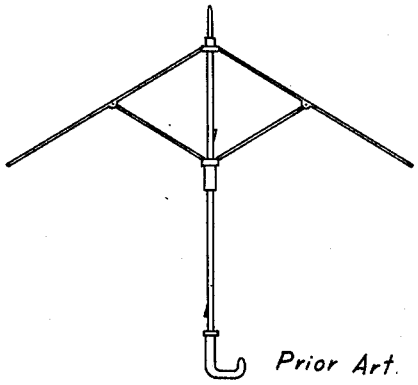
FIG. 1, is a schematic illustration of an conventional umbrella.
Figure 2:
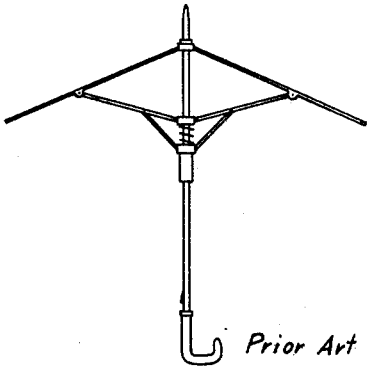
FIG. 2, is a schematic illustration of an conventional umbrella which can be automatically opened.
Figure 3:
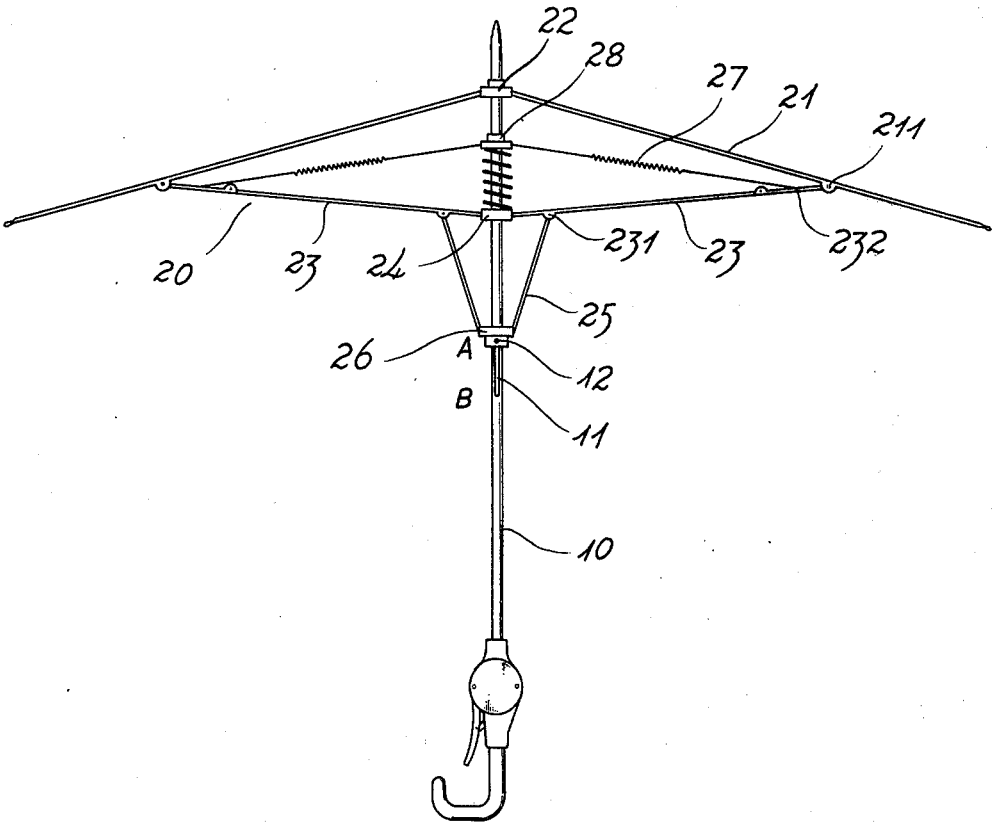
FIG. 3, is a schematic illustration of the present invention which can be opened and closed by a single hand, operation.

Referring to FIG. 3, which is an illustration of the present invention. The ribs structure 20 comprises a notch 22 which is near the top portion of shaft 10 with a plurality of main ribs 21 adopted thereto, an auxiliary runner 24 which is freely thimbled on the shaft 10 with a plurality of stretchers 23 adopted thereto, a runner 26 which is also freely thimbled on the shaft 10 with a plurality of auxiliary ribs 25 adopted thereto and a spring runner 28 which is located between the notch 22 and the auxiliary runner 24 with a plurality of coil springs 27 connected thereto. The tip of the auxiliary rib 25 is set on the eyelet 231 of the stretcher 23 near the shaft 10. The tip of the coil spring 27 is set on another eyelet 232 of the stretcher 23. Meanwhile, the tip of the stretcher 23 is set on the eyelet 211 of the main rib 21. The structure described above is nothing but a simple design which can be developed by a person skilled in the art and is not the characterizing features of the present invention.

Still referring to FIG. 3, there are two diametrically symmetric slits 11 on the shaft 10 near the runner 26. The runner 26 which is inserted by a pin 12 through the slit 11 on the shaft 10, may be freely moved up and down in about the shaft.

Figure 4:
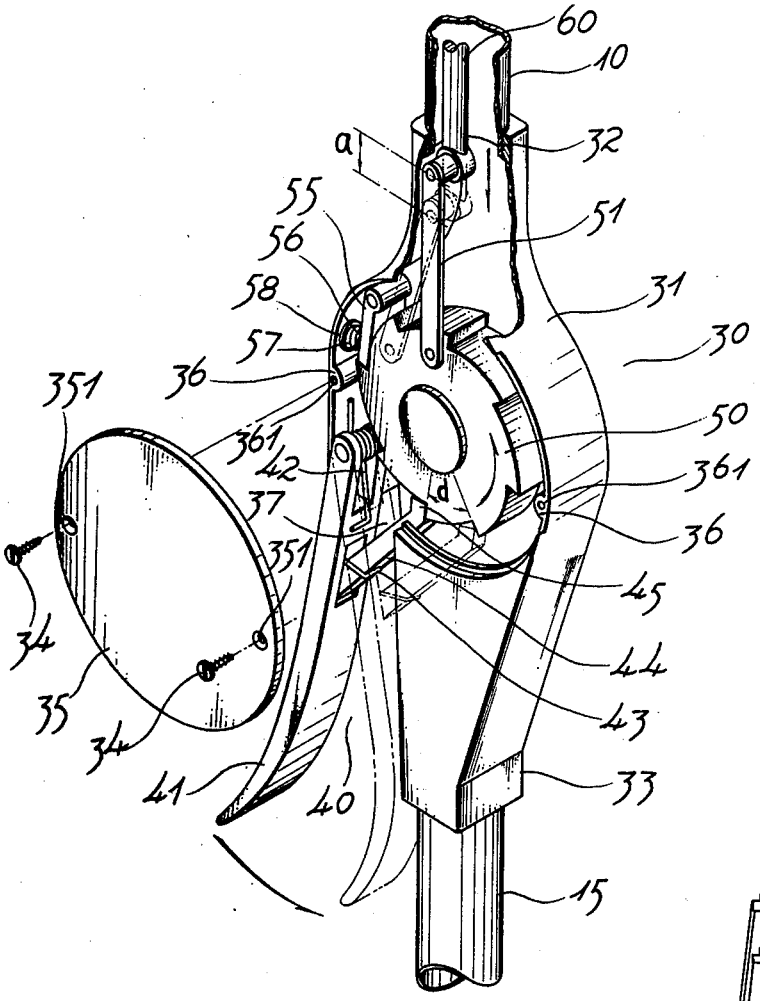
FIG. 4, is an exploded view of the automatic opening and closing device of an umbrella according to the present invention.

Referring to FIG. 4, which is an exploded view of the automatic opening and closing device of the present invention. The casing 30 comprises an oval slab 31 with an circle opening, and two connecting cylinders 32, 33 with female threads formed therein for engaging with the shaft 10 and the handle 15 respectively. Two screws 34, through the holes 351 of the disc cover 35, are used to screw into the female thread 361 of the studs 36 for engaging said disc cover 35 to the casing 30. An opening 37 is made on the casing 30 near the handle 15.

A trigger lever 41 is mounted near the edge of the opening 37 of the casing 30 and extending therefrom by the actuation of a spring 42. Connected to the trigger lever 41, there is provided a ratchet pawl 45 which is compressed by a spring 43 and is buckled to push the ratchet gear 50 when the trigger lever 41 is pressed down.

There are a plurality of teeth on the ratchet gear 50 which is pivoted on a central stud inside the casing 30. On the edge of the ratchet gear 50, there is a movable plate 51 connected thereto with one tip thereof joined with a steel wire 60 which in turn is again connected to the pin 12 on the runner 26.

A check pawl 55 which is set inside the casing 30, can rotate freely. The check pawl 55 is set against the tooth of the ratchet gear 50 to prevent the later from reverse rotation. A small spring 57 adopted between the check pawl 55 and the casing 30 is used to push the check pawl 5 against the tooth of the ratchet gear 50.

Figure 5:
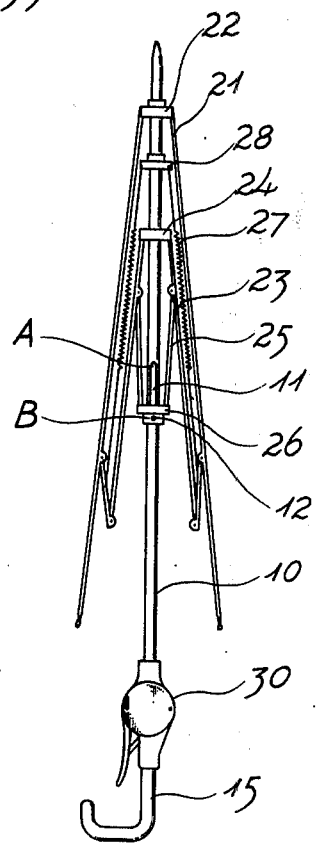
FIG. 5, is a schematic illustration of the present invention in its closed mode.

In operation, please refer to FIGS. 4 and 3, with reference to FIG. 5. By pressing down the trigger lever 41, the ratchet pawl 45 will push the ratchet gear 50 to rotate over an arc distance d so as to result the steel wire 60 decent a corresponding distance a. Continuing to press the trigger lever 41 to actuate the ratchet gear 50 rotating for a half cycle, (There are four teeth on half cycle of the ratchet gear in the present embodiment), the runner 26 would move from position A to B of the slit 12, to close the umbrella. It can be easily understood that, when the ratchet gear 50 rotates for another half cycle, the steel wire 60 will arise and the runner 26 would move from position B to A of the slit 12 to open the umbrella.

What I claim is:

1. A device for opening and closing an umbrella comprising:

a casing having two connecting cylinders with female threads formed therein for engaging with the shaft and the handle;

a trigger lever mounted near the edge of an opening of said casing for actuating the device;

a ratchet gear pivoted on a central stud inside the casing of the device, with a movable plate rotatably mounted on the edge thereof; and being actuated by said trigger lever;

a check pawl, set inside the casing the device for preventing the ratchet gear from reverse rotation;

a steel wire, with one end mounted the tip of said movable plate, adopted in the shaft of an umbrella with the other end thereof connected to the runner; the steel wire will move up or down when said ratchet gear is actuated by the trigger lever, thereby to open or close the umbrella.

2. A device for opening and closing an umbrella according to claim 1, wherein said trigger lever further comprises a ratchet pawl cooperating with the teeth of the ratchet gear for pushing said gear to rotate when the trigger lever is pressed down.

3. A device for opening and closing an umbrella according to claim 1, further comprising a spring for actuating said trigger lever making the ratchet pawl of the trigger lever in touch with the teeth of the ratchet gear.

4. A device for opening and closing an umbrella according to claim 1, wherein said ratchet gear pivoted on the central stud inside the casing of the device, has a plurality of teeth; each time the trigger lever is pressed and closed, said ratchet gear is advanced by one tooth; said movable plate, rotating along with said ratchet gear, will move the steel wire to go up or down for opening or closing the umbrella.

* * * * *